US008919986B2

(12) United States Patent
Yang

(10) Patent No.: US 8,919,986 B2
(45) Date of Patent: Dec. 30, 2014

(54) CHRISTMAS TREE LIGHTING DECORATION

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 13/831,622

(22) Filed: Mar. 15, 2013

(65) Prior Publication Data

US 2014/0268688 A1 Sep. 18, 2014

(51) Int. Cl.
*F21S 6/00* (2006.01)
*F21V 33/00* (2006.01)

(52) U.S. Cl.
CPC ..... *F21V 33/0028* (2013.01)
USPC ..... 362/123; 362/134; 362/101; 362/284

(58) Field of Classification Search
USPC ..... 362/123, 134, 101, 284
See application file for complete search history.

(56) References Cited

U.S. PATENT DOCUMENTS

| | | | | | |
|---|---|---|---|---|---|
| 457,397 | A * | 8/1891 | Church | 446/241 |
| 1,681,040 | A * | 8/1928 | Kemp | 362/134 |
| 2,108,002 | A * | 2/1938 | Smith et al. | 40/440 |
| 2,113,038 | A * | 4/1938 | Thalinger | 428/7 |
| 2,757,472 | A * | 8/1956 | Corwin | 40/310 |
| 2,841,901 | A * | 7/1958 | Maple | 428/9 |
| 4,145,731 | A * | 3/1979 | Adamich | 362/123 |
| 4,170,035 | A * | 10/1979 | Walker | 362/96 |
| 4,214,747 | A * | 7/1980 | Rebajes | 472/57 |
| 4,437,262 | A * | 3/1984 | Kaga | 446/138 |
| 4,637,941 | A * | 1/1987 | Rochte | 428/8 |
| 4,916,752 | A * | 4/1990 | Thompson | 40/427 |
| 5,065,289 | A * | 11/1991 | Teng | 362/101 |
| 5,374,217 | A * | 12/1994 | Olson | 472/57 |
| 6,203,394 | B1 * | 3/2001 | Lee | 446/159 |
| D527,676 | S * | 9/2006 | Weiser et al. | D11/141 |
| 2002/0141187 | A1 * | 10/2002 | Lin | 362/284 |
| 2009/0135586 | A1 * | 5/2009 | Yang | 362/101 |

* cited by examiner

*Primary Examiner* — Thomas A Hollweg
(74) *Attorney, Agent, or Firm* — Leong C. Lei

(57) ABSTRACT

The present invention provides a Christmas tree lighting decoration, which includes a base, an aqua light, and a decoration unit. The base receives therein a light-emitting element and a rotation mechanism. The aqua light is of a light-transmitting conic configuration and is mounted on the base. The decoration unit is helically around an outside surface of the aqua light and is mounted to the rotation mechanism to be rotated in unison therewith. As such, when the rotation mechanism of the base drives the decoration unit to rotate, a dynamic effect is generated. Further, the light-emitting element irradiates light onto the aqua light to provide a beautiful visual effect.

3 Claims, 5 Drawing Sheets

CHRISTMAS TREE LIGHTING DECORATION

TECHNICAL FIELD OF THE INVENTION

The present invention generally relates to a Christmas tree lighting decoration, and more particularly to a lighting decoration for visual object in an ambient environment.

DESCRIPTION OF THE PRIOR ART

Commonly used decorations of daily living that are placed on desk top are generally photo frames and toy decorations. All these decorations provide only a static function of being beautiful for visual perception. An aqua light that contains therein shining flasks or powders or small decorations is available in the market, which provides a vivid visual perception of floating of the shining flasks or powders and decorations when be reversed manually or by application of electrical power. With the articles contained in the aqua light being different, the visual effect be perceived are also different and expansion of such a structure is promising to allow it to extend to various effects of visual variations or multiple functions or funs. Thus, the design of aqua light is a special topic for manufacturers of ambient decorations.

In view of this, the present invention aims to provide a decoration that, besides being placed in a static manner, provides a dynamic effect of rotation so as to provide enhanced effects of decoration, beautification, and fun.

SUMMARY OF THE INVENTION

Thus, the present invention provides a Christmas tree lighting decoration, which comprises:

a base, which receives therein a light-emitting element and a rotation mechanism that is driven by a power device to rotate, the rotation mechanism comprising a mounting seat formed at one side thereof;

an aqua light, which is of a hollow light-transmitting conic configuration hermetically receiving therein a thick flowable liquid and is securely mounted on the base; and a decoration unit, which comprises a wire helically around an outer surface of the aqua light and a plurality of ornaments attached to the wire, the wire having an end forming a fixing section, the decoration unit being fixed by the fixing section to the mounting seat to be rotatable in unison with the rotation mechanism;

wherein when the rotation mechanism of the base drives the decoration unit to rotate, a dynamic effect is generated and at the same time, the decoration unit irradiates light on the aqua light to provide a beautiful visual effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
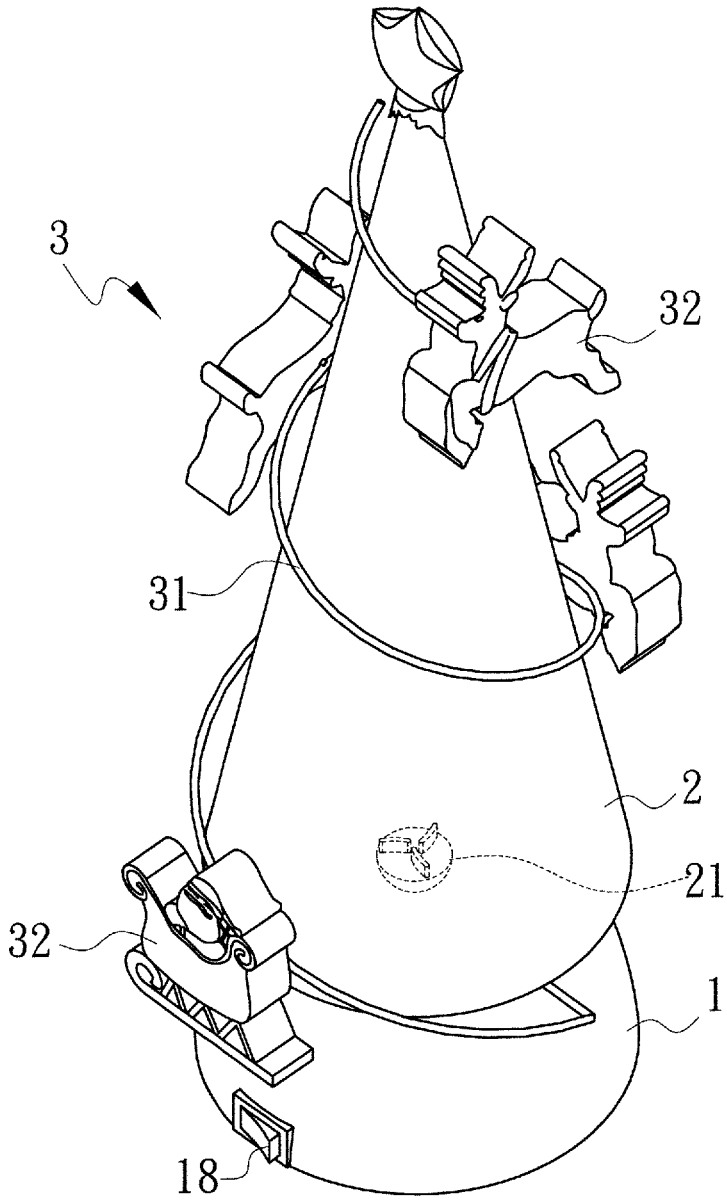
FIG. 1 is a perspective view showing the present invention.
Figure 2:
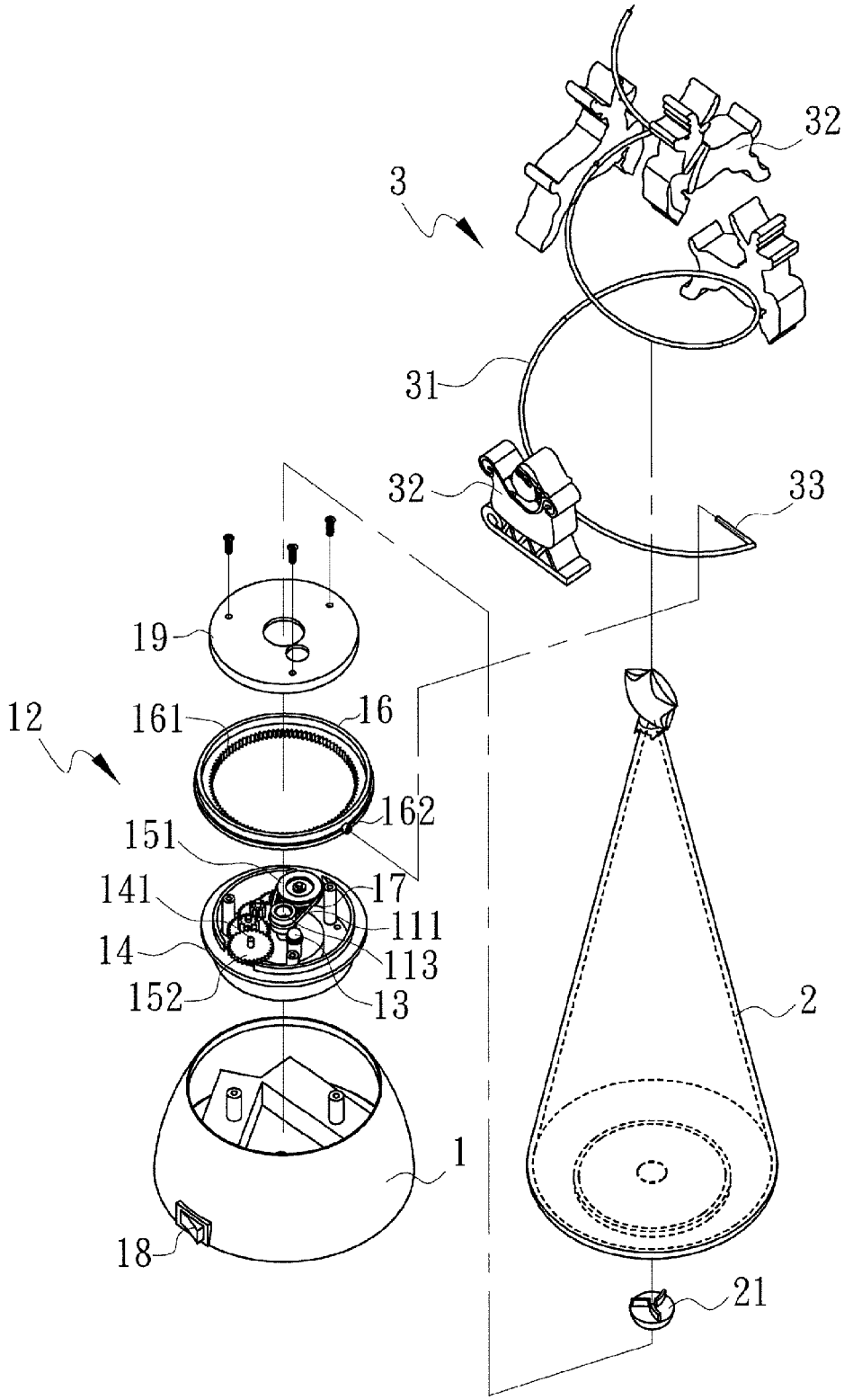
FIG. 2 is an exploded view of the present invention.
Figure 3:
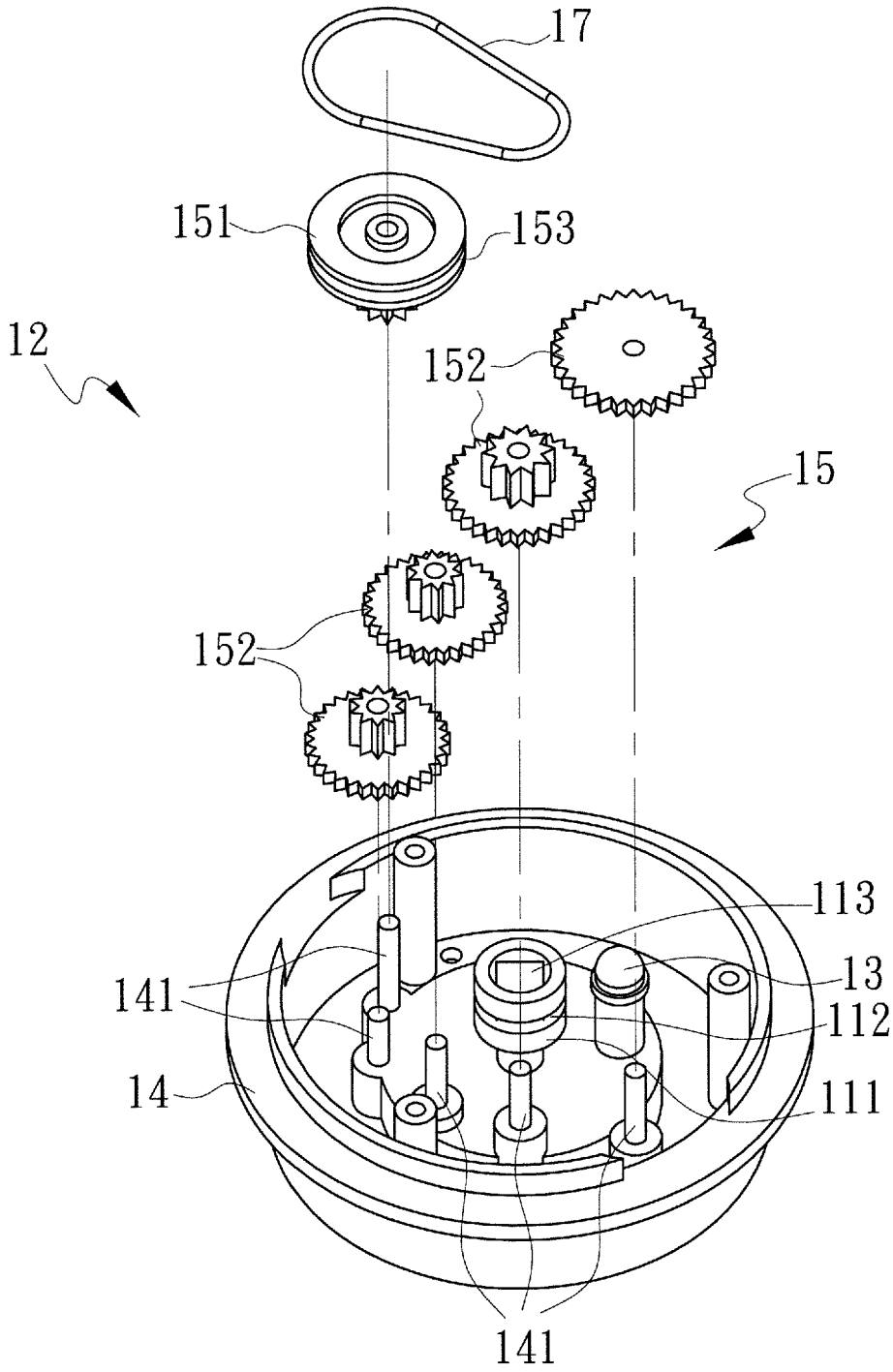
FIG. 3 is an exploded view of a rotation mechanism of the present invention.

Referring to FIGS. 1-3, which are respectively a perspective view, an exploded view, and a partial exploded view of a Christmas tree lighting decoration according to the present invention, the Christmas tree lighting device comprises a base 1, an aqua light 2, and a decoration unit 3.

The base 1 has an opening facing upward. The base 1 receives therein a rotation mechanism 12 that is driven by a power device 11 to rotate and comprises a light-emitting element 13 corresponding to a bottom of the aqua light 2. The rotation mechanism 12 comprises a main body 14, a driving gear train 15, and a rotary ring 16. In the instant embodiment, the main body 14 is in the form of a bowl and the main body 14 has a bottom from which a plurality of mounting shafts 141 extends upwards in a manner of being spaced from each other. The driving gear train 15 comprises a first gear 151 and a plurality of second gears 152. The first gear 151 and the second gears 152 are rotatably mounted on the mounting shafts 141 in such a way that the gears mate each other. The first gear 151 has a top portion in which a circumferential groove 153 is formed. The power device 11 comprises a rotation spindle 111 extending upward. The spindle 111 comprises a circumferential slot 112 corresponding to the groove 153. A belt 17 is set between and fit in the groove 153 and the slot 112 to form a coupling therebetween. The rotary ring 16 is fit to a top of the main body 14. The rotary ring 16 has inner teeth 161 and the inner teeth 161 mate the driving gear train 15. The rotary ring 16 comprises a mounting seat 162 formed at one side thereof and also comprises a top cover 19 arranged above the driving gear train.

The LED lighting device 1 comprises a switch 18 mounted to one side thereof and in connection with a power supply device to supply electrical power. The switch 18 controls the light-emitting element 13 to light on/off. The light-emitting element 13 can be a light-emitting diode.

The aqua light 2 is of a hollow light-transmitting conic configuration hermetically receiving therein a thick flowable liquid and is securely mounted on the base 1. The aqua light may further contain therein shining flasks and powders to provide different visual effects.

The decoration unit 3 comprises a wire 31 helically around an outer surface of the aqua light 2 and a plurality of ornaments 32 attached to the wire 31. The wire 31 has an end forming a fixing section 33. The decoration unit 3 is fixed by the fixing section 33 to the mounting seat 162 to be rotatable in unison with the rotary ring 16 of the rotation mechanism 12.

As such, the power device 11, when activated, drives, via the belt 17, the driving gear train 15 to rotate and the rotary ring 16 is caused to rotate therewith for driving the decoration unit 3 that is mounted at one side thereof and helically surrounding outer surface of the aqua light 2 to rotate (see FIG. 5) thereby showing a dynamic effect. Meanwhile, the light from the light-emitting element 13 is irradiated onto the interior of the aqua light 2 to provide a beautiful visual effect.

Figure 4:
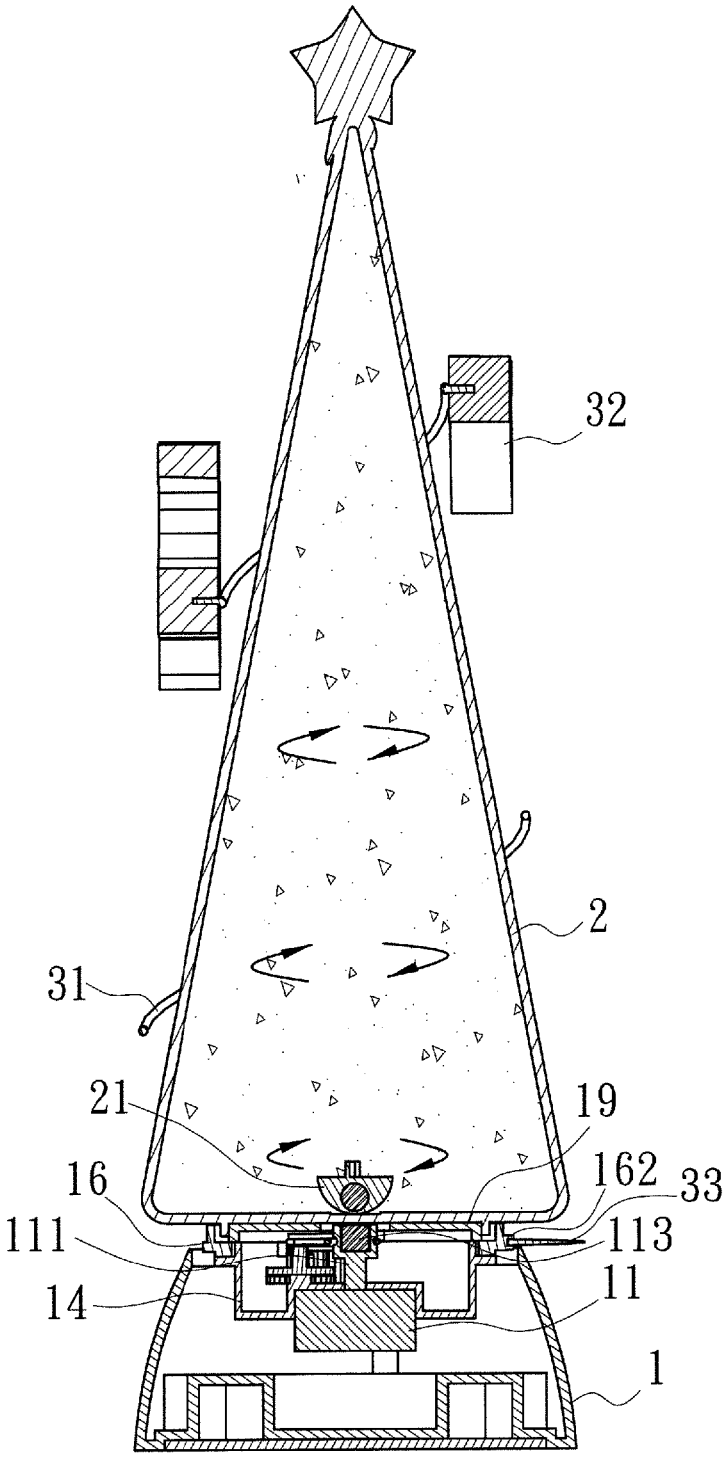
FIG. 4 is a cross-sectional view of the present invention.
Figure 5:
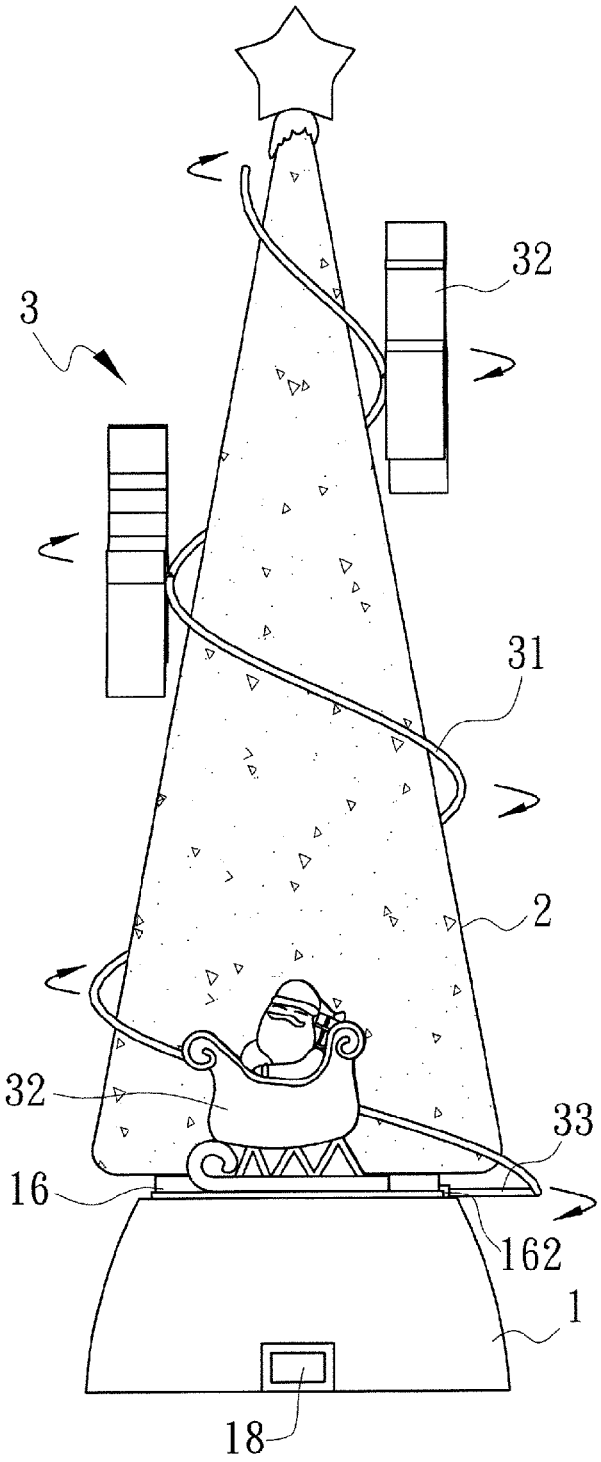
FIG. 5 is a schematic view showing an operation of the present invention.

Referring to FIGS. 4 and 5, which are respectively a cross-sectional view of the present invention and a schematic view illustrating an operation of the present invention, in the instant embodiment, the spindle 111 of the power device 11 comprises a magnetic attraction element 113 mounted thereto to correspond to the bottom of the aqua light 2. The aqua light 2 comprises a magnetically driven element 21 arranged therein to be attracted by and magnetically coupled to the magnetic attraction element 113. As such, when the spindle 111 rotates, the magnetic attraction element 113 is caused to drive the magnetically driven element 21 to rotate thereby disturbing the liquid contained in the aqua light 2 and causing the shining flasks and/or powders to move and float with the liquid flow so as to provide different visual effects.

In summary, it can be seen from the above description that the present invention has several advantages:

(1) The present invention provides a Christmas tree lighting decoration, which comprises ornaments that are arranged to helically surround the outside surface of the aqua light and are driven to rotate so as to provide a dynamic effect.

(2) The present invention provides a Christmas tree lighting decoration that comprises an aqua light in which a magnetically driven element is arranged to be attracted by and operatively coupled to a magnetic attraction element mounted to a power device so that shining flasks and/or powders contained in the aqua light can be stirred to float in the liquid of the aqua light thereby providing additional visual effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A Christmas tree lighting decoration, comprising:

a base, which receives therein a light-emitting element and a rotation mechanism that is driven by a power device to rotate, the rotation mechanism comprising a mounting seat formed at one side thereof;

an aqua light, which is of a hollow light-transmitting conic configuration hermetically receiving therein a thick flowable liquid and is securely mounted on the base; and a decoration unit, which comprises a wire helically around an outer surface of the conic configuration of the aqua light and a plurality of ornaments attached to the wire, the wire having an end forming a fixing section, the decoration unit being fixed by the fixing section to the mounting seat to be rotatable in unison with the rotation mechanism so that the ornaments are movable along and relative to the outer surface of the conic configuration of the aqua light;

wherein the power device comprises a magnetic attraction element corresponding to a bottom of the aqua light, the aqua light comprising a magnetically driven element arranged therein to be attracted by and magnetically coupled to the magnetic attraction element for driving the liquid to flow inside the conic configuration so that the rotation mechanism is operable to simultaneously drive the ornaments to move along the outer surface of the conic configuration of the aqua light and drive the liquid to flow inside the conic configuration of the aqua light; and wherein when the rotation mechanism of the base drives the decoration unit to rotate, a dynamic effect is generated and at the same time, the decoration unit irradiates light on the aqua light to provide a beautiful visual effect.

2. The Christmas tree lighting decoration according to claim 1, wherein the rotation mechanism comprises a main body, a driving gear train, and a rotary ring, the main body comprising a plurality of mounting shafts, the driving gear train being rotatably mounted to the mounting shafts and driven by the power device, the rotary ring being fit to a top of the main body, the rotary ring having inner teeth that mate the driving gear train, the mounting seat being formed at one side of the rotary ring.

3. The Christmas tree lighting decoration according to claim 1, wherein the light-emitting element comprises a light-emitting diode.

* * * * *